US006935209B2

(12) United States Patent
Lantow et al.

(10) Patent No.: US 6,935,209 B2
(45) Date of Patent: Aug. 30, 2005

(54) KEY AND KEY HOLDER FOR FASTENER INSTALLATION TOOL

(75) Inventors: Richard C. Lantow, Yorba Linda, CA (US); Charles H. Dibley, Mission Viejo, CA (US)

(73) Assignee: Alcoa Global Fasteners, Inc., Torrance, CA (US)

( * ) Notice: Subject to any disclaimer, the term of this patent is extended or adjusted under 35 U.S.C. 154(b) by 73 days.

(21) Appl. No.: 10/653,675

(22) Filed: Sep. 2, 2003

(65) Prior Publication Data

US 2005/0044993 A1 Mar. 3, 2005

(51) Int. Cl.[7] ..... B25B 33/00
(52) U.S. Cl. ..... 81/55; 81/56; 81/57.36
(58) Field of Search ..... 81/55, 56, 57.36

(56) References Cited

U.S. PATENT DOCUMENTS

| | | | | |
|---|---|---|---|---|
| 1,390,071 A | | 9/1921 | Wetzstein | |
| 2,007,432 A | | 7/1935 | Mancuso | 81/55 |
| 2,570,230 A | | 10/1951 | Hammond | 81/3 |
| 3,789,705 A | | 2/1974 | Naslund | 81/13 |
| 4,538,483 A | | 9/1985 | Batten | |
| 4,544,312 A | | 10/1985 | Stencel | |
| 4,617,844 A | | 10/1986 | Batten | |
| 4,721,022 A | | 1/1988 | Batten | |
| 4,762,030 A | | 8/1988 | Nguyen | 81/55 |
| 5,109,735 A | | 5/1992 | Hart | |
| 5,305,666 A | * | 4/1994 | LaTorre | 81/55 |
| 5,461,947 A | | 10/1995 | Batten | |
| 5,553,519 A | | 9/1996 | Pettit, Jr. | |
| 5,699,702 A | | 12/1997 | Myers | |
| 5,778,741 A | | 7/1998 | Batten | |
| 6,015,351 A | | 1/2000 | Elcock et al. | |
| 6,237,450 B1 | | 5/2001 | Cosenza | |
| 2004/0177724 A1 | * | 9/2004 | Pettit, Jr. | 81/55 |

* cited by examiner

*Primary Examiner*—James G. Smith
(74) *Attorney, Agent, or Firm*—David P. Maivald; Eckert Senmans Cherin & Mellott, LLC

(57) ABSTRACT

A fastener installation tool is provided that is used to install a threaded nut onto a threaded fastener of the type having a non-circular recess in an end of the fastener that matingly engages with a male member that has a complementary shaped non-circular tip end to the non-circular recess. The fastener installation tool generally has a head, a gear, a socket, a key, a key holder and a spring. The key has a shank with a non-circular external surface that matingly engages with a non-circular aperture in the key holder. The mating engagement between the key and the key holder provides the key with resistance to rotation and permits the use of a lower gauge spring that facilitates replacement of the key from the fastener installation tool. The key, key holder and spring are also available as a kit for retrofitting a fastener installation tool.

12 Claims, 4 Drawing Sheets

KEY AND KEY HOLDER FOR FASTENER INSTALLATION TOOL

FIELD OF THE INVENTION

This invention relates to a fastener installation tool and more particularly to a key and a key holder for the fastener installation tool.

BACKGROUND OF THE INVENTION

Threaded fasteners are frequently used in loose and interference fit applications in which it is difficult to work from both sides of workpieces to be secured together. In such applications, it has been the practice to use a fastener installation tool having a key which is inserted into a broached recess of a fastener to hold the fastener stationary while a non-circular threaded nut is threaded on the fastener with the installation tool. When the nut is threaded on the fastener with the tool and the fastener is restrained against rotation by the key to secure the workpieces together in a fastened joint, the fastener is set.

In the prior art, springs were used to prevent the key from rotating relative to the fastener during installation of the nut. Oftentimes, the spring would fatigue and fail during the installation process which requires replacement of the spring in a time consuming process. Because the spring fatigues, the spring was typically manufactured from large diameter spring stock which makes it difficult for an operator of the installation tool to keep the key engaged in the recess of the fastener during the installation process. Without proper engagement of the key with the recess of the fastener, the nut will not thread on the fastener in a reliable manner. Unreliable installations are not acceptable in mission critical applications. Also, a problem that exists with this type of fastener installation tool is the tendency of the key to twist or otherwise deform. Additionally, changing the key after damage or to a different sized key is a relatively slow procedure when a spring made from a large diameter spring stock is used to prevent the key from rotating relative to the fastener during installation of the nut.

SUMMARY OF THE INVENTION

It is an object of the invention to provide a key for a fastener installation tool that has an improved key holder that provides resistance to twisting deformation or bending of the key.

It is another object of the invention to provide a key for a fastener installation tool that can be quickly changed to replace a damaged key or a different size.

It is an additional object of the invention to provide a key holder for a fastener installation tool that provides anti-rotation to the key of the fastener installation tool.

These objects of the invention are achieved by providing a fastener installation tool of the type used for installing a threaded nut with a non-circular external surface onto a threaded fastener of the type having a non-circular recess in an end of the fastener that matingly engages with a male member that has a complementary shaped non-circular tip end to the non-circular recess. In general, the fastener installation tool has a head, a gear, a socket, a key, a key holder and a spring. The gear is disposed within the head, is rotatably operable and has a non-circular bore. The socket has a non-circular seat configured to matingly engage the non-circular nut that has a complementary shaped non-circular external shape to the non-circular seat. The socket also has a shaft with a non-circular external surface and a tubular bore internal surface. The shaft matingly engages within the bore of the gear having a complementary shaped non-circular shape to the non-circular external surface of the shaft. The key has a shank with a non-circular external surface and a tip end with a non-circular external surface. The shank of the key is disposed within the tubular bore of the shaft. The tip end of the key is configured to matingly engage with a complementary shaped non-circular recess in the fastener of the type having the non-circular recess in the end of the fastener. The key holder has a non-circular aperture that matingly engages the shank of the key having a complementary shaped non-circular shape to the non-circular aperture. The key holder is attached to the exterior surface of the head. The spring has one end of the spring attached to the key and another end of the spring attached to the head. Also, the key, key holder and spring described in this paragraph are available as a kit for retrofitting a fastener installation tool that has a head, a gear and a socket of the type described in this paragraph.

DETAILED DESCRIPTION OF PREFERRED EMBODIMENTS

Figure 1:
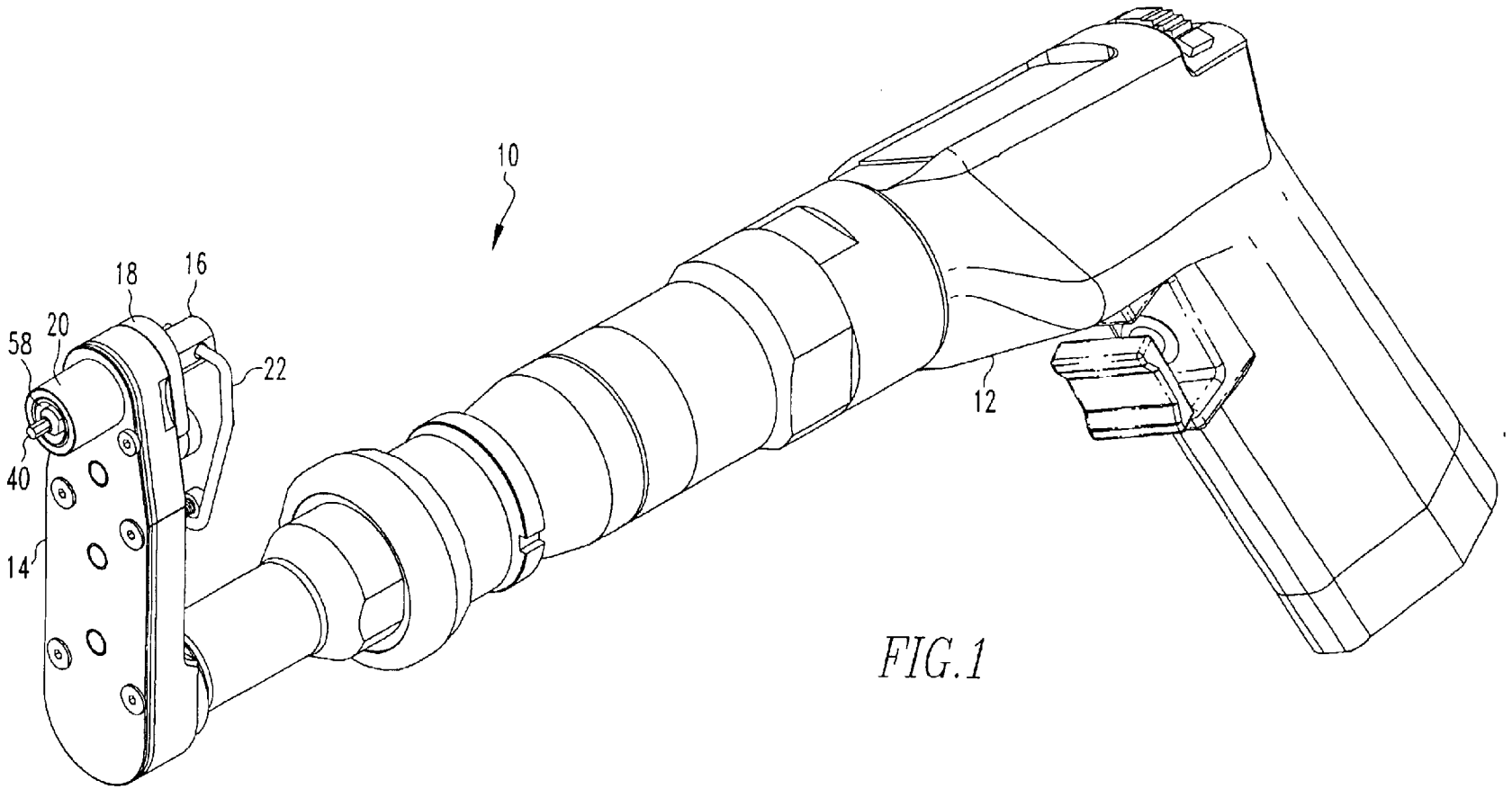
FIG. 1 is an isometric view of the fastener installation tool of the invention showing the tool component and the head.

With reference to FIG. 1, a fastener installation tool 10 is shown which has a tool component 12 secured to a head 14. The head 14 has a key 16, a key holder 18, a socket 20 and a spring 22 mounted thereto which will be described in greater detail below. The fastener installation tool 10 is used for installing a threaded fastener 24 through aligned openings 26 and 28 located in workpieces 30 and 32.

Figure 5:
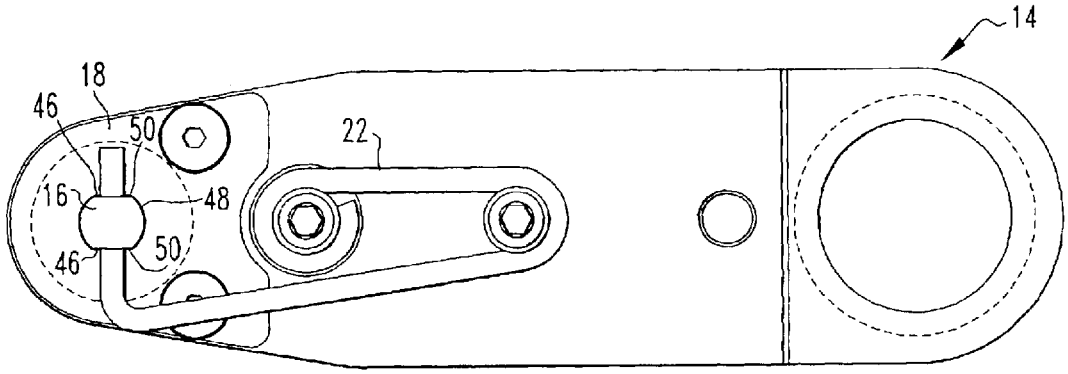
FIG. 5 is a top plan view of the head of the invention.
Figure 2:
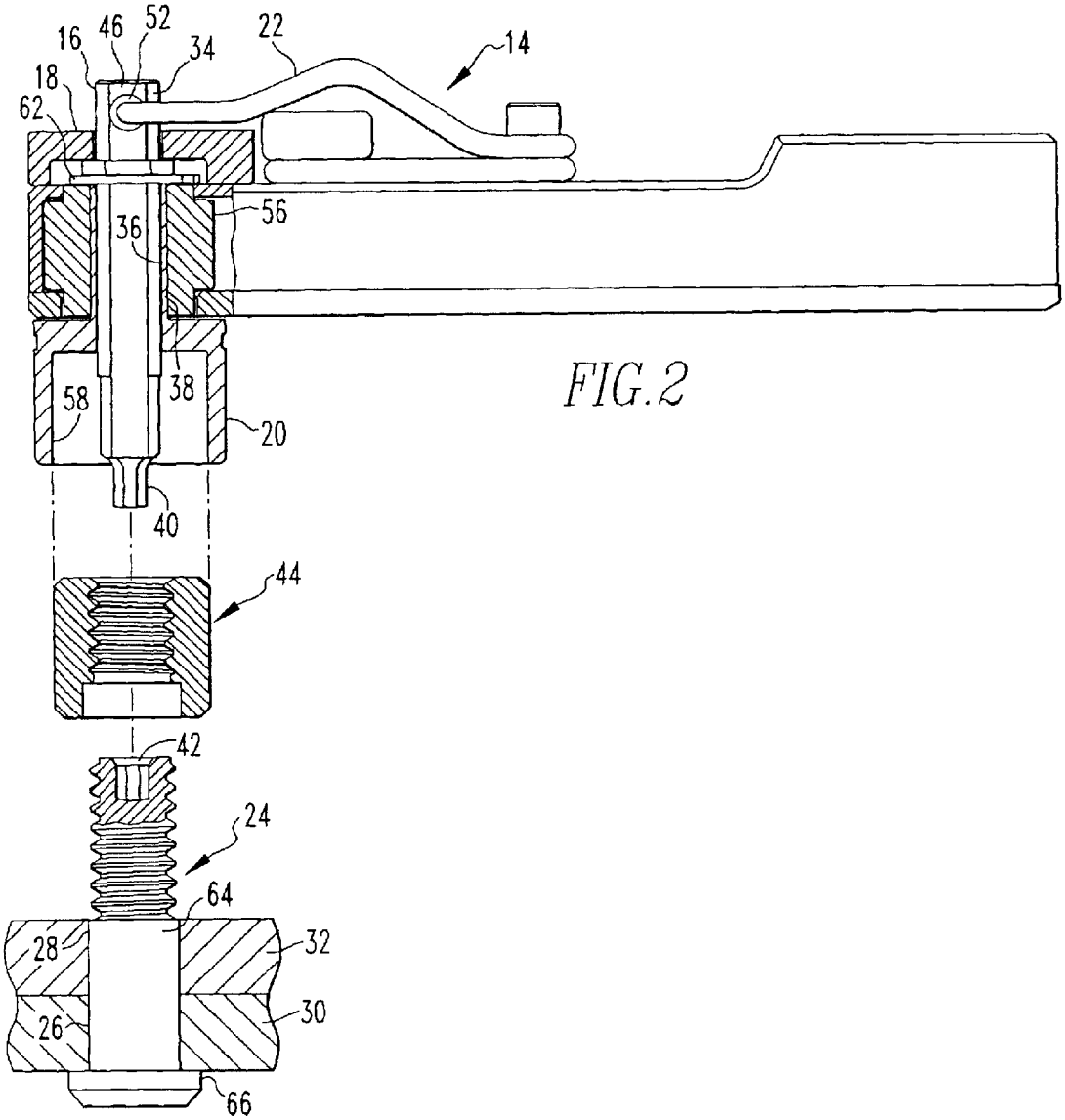
FIG. 2 is a side partial cross-sectional view of the head of the invention.
Figure 3:
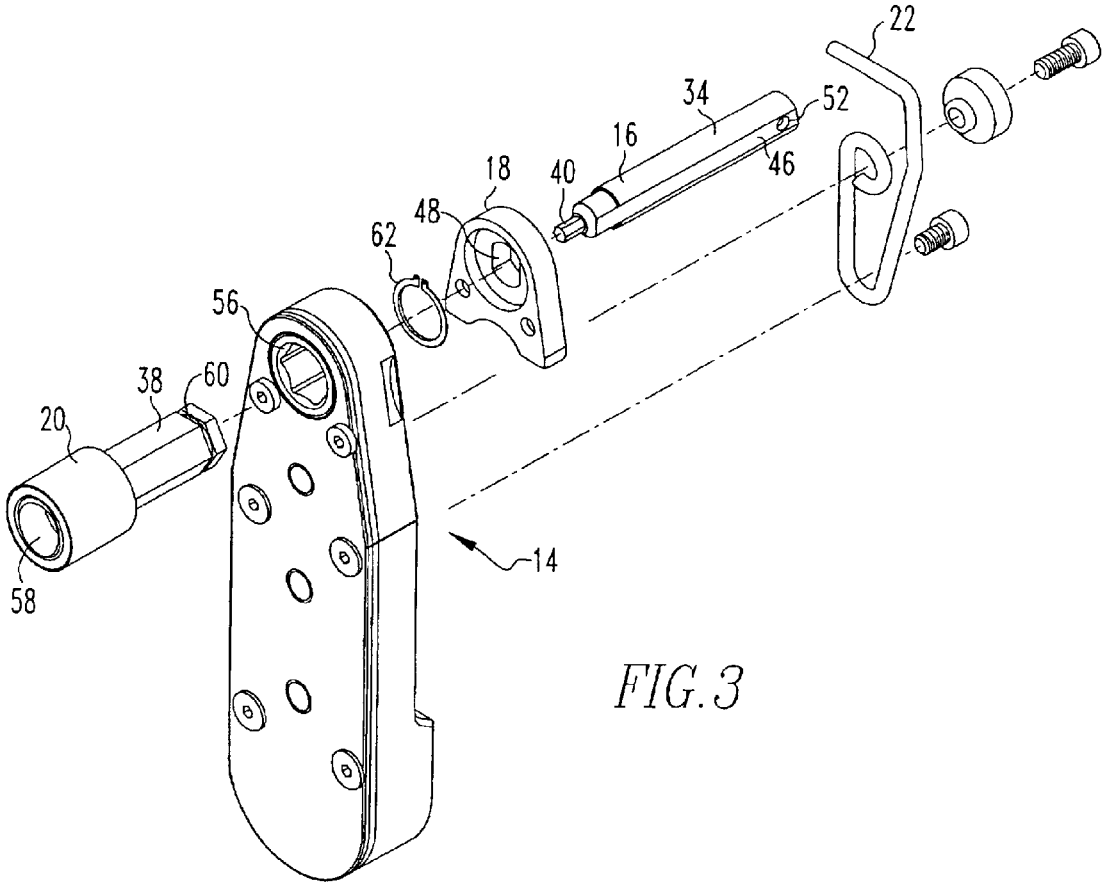
FIG. 3 is an isometric partially exploded view of the head of the invention.
Figure 4:
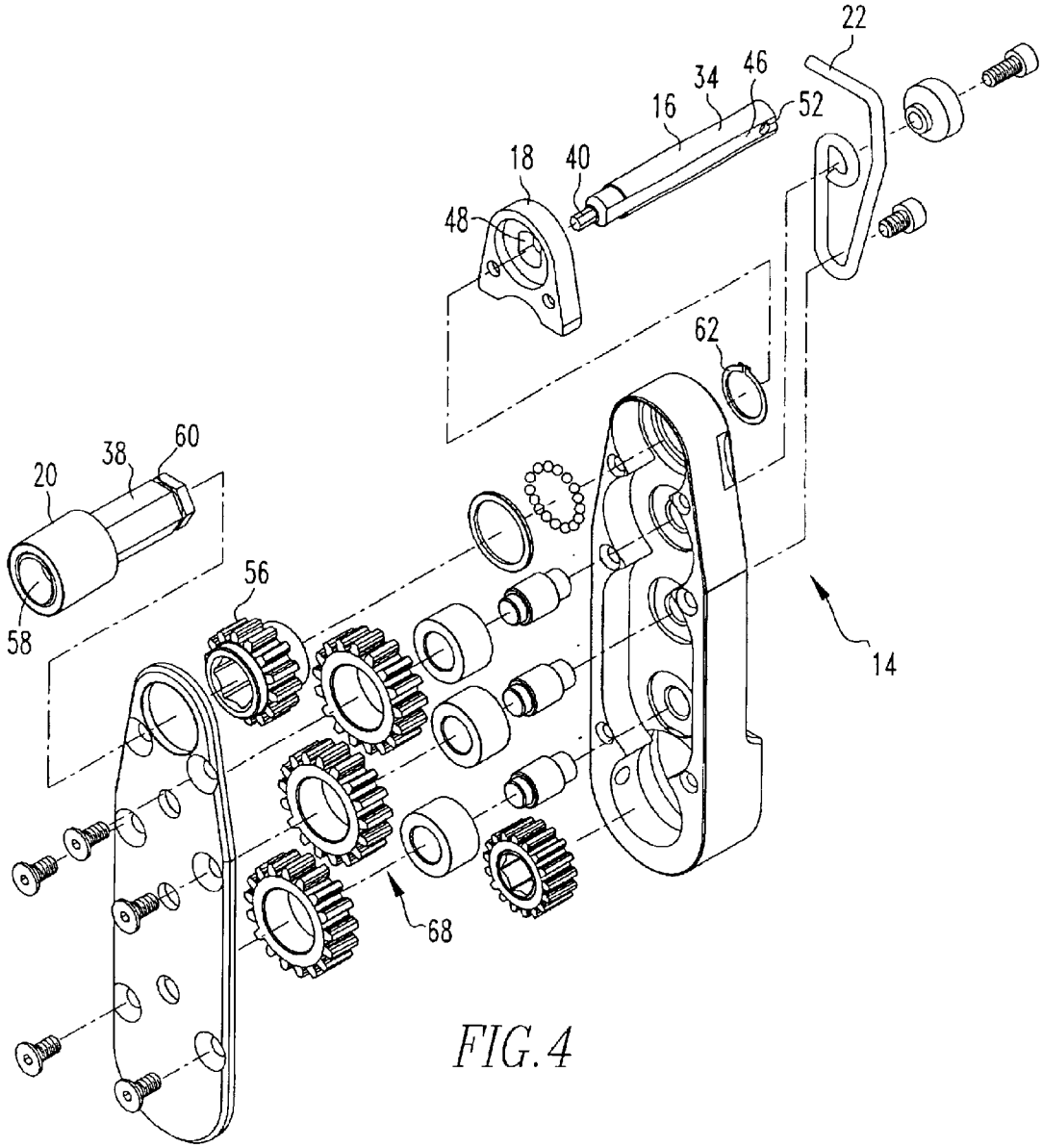
FIG. 4 is an isometric exploded view of the head of the invention.

With reference to FIGS. 2–4, the key 16 has a shank 34 wherein a portion of the shank 34 is supported in a slip fit within a tubular bore 36 of a shaft 38 of the socket 20. The shaft 38 is integrally connected with the socket 20. The key 16 includes a non-circular tip end 40 for seated reception within a matingly shaped non-circular recess 42 formed in an end of the fastener 24, to support the fastener 24 against rotation during installation of a non-circular threaded nut 44. For example, the tip end 40 and recess 42 could be fluted, hexagonal or splined so long as the tip end 40 and recess 42 are adapted to mate with the other component. Other non-circular shapes that have one or more flats could be used in tip end 40 and recess 42 as well. The shank 34 includes a pair of opposed flats 46 disposed within a matingly shaped aperture 48 in the key holder 18 that has a complementary pair of opposed flats 50 to the shank 34. The key holder 18 is a plate secured to the exterior surface of the head 14 with fasteners and prevents rotation of the key 16 during installation of the threaded nut 44. As shown in the FIGS., the key holder 18 is located exclusively on the outside of the exterior surface of the head 14. The shape of the opposed flats on the shank 34 and the aperture 48 are commonly referred to as a double-D shape. One can see the double-D shape and mating engagement of the shank 34 within the aperture 48 in greater detail with reference to FIG. 5. In an alternative embodiment, the shank 34 and the aperture 48 could be provided with any non-circular shape so long as the shank 34 is supported in a slip fit within the tubular bore 36 and the shank 34 mates within a complementary shaped aperture 48. For example, the shank 34 and the aperture 48 could be provided with one or more complementary shaped flats that mate with each other. As another example, the shank 34 and the aperture 48 could be provided with one or more flutes or splines that mate with each other. Other non-circular shapes could be used on the shank 34 and aperture 48 as well. In these alternative embodiments, the key holder 18 is secured to the exterior surface of the head 14 with fasteners and prevents rotation of the key 16 during installation of the threaded nut 44 as well. Also, the key 16 is made of forged steel or other forged metallic alloys that provides the key 16 with greater strength and durability over prior art keys used in the industry. Alternatively, the key could be made of cast steel, other cast metallic alloys, machined steel bar stock, or other machined metallic alloy bar stock.

The key 16 additionally has a bore 52 located adjacent to an end opposite to the tip end 40. One end of the spring 22 is disposed within the bore 52 and another end of the spring 22 is secured to the head 14 with fasteners. The spring 22 operates to bias the key 16 along a longitudinal axis of the shaft 38 of the socket 20. In an alternative embodiment, one end of the spring 22 could be secured within a slotted groove (not shown) disposed in an end of the key 16 opposite to the tip end 40 and another end of the spring 22 could be secured to the head 14 with fasteners. Other approaches to securing the spring 22 to the key 16 could be used as well.

In the prior art, a large gauge spring was typically used to provide a key with anti-rotation of the key relative to the fastener, to bias the key along a longitudinal axis of the shaft of the socket. Conversely, the key holder 18 of the instant invention which provides anti-rotation of the key 16 relative to the fastener 24 during installation of the fastener 24 allows the use of a spring 22 with a smaller gauge that is only used to bias the key 16 along a longitudinal axis of the shaft 38 of the socket 20 and retain the key 16. Use of a spring 22 with a smaller gauge facilitates replacement and removal of the key 16 without the need of additional tools needed to manipulate a spring made from large diameter spring stock.

The exterior surface of the shaft 38 of the socket 20 has a non-circular shape that is disposed in a slip fit within a non-circular bore of a gear 56 so the socket 20 rotates with the gear 56 during actuation of the fastener installation tool 10. The socket 20 also has non-circular seat 58 that is adapted to receive a complementary shaped non-circular threaded nut 44 to be secured to the threaded fastener 24. While a standard threaded nut 44 is shown in FIG. 2, it is understood that a frangible threaded nut or nut of the type shown in U.S. Pat. Nos. 4,544,312, 6,015,351 and 6,237,450 could be used with the fastener installation tool 10 of the present invention as well. With regard to use of such other non-circular threaded nuts, a socket 20 with a complementary shaped non-circular seat 58 would be used. The exterior surface of the shaft 38 additionally has an annular groove 60 that has a ring 62 seated therein to lock the socket 20 to the gear 56.

As shown in FIG. 2, the fastener 24 has an elongated shank 64 which terminates at one end in an enlarged head 66. The shank 64 has a size and shape to fit through openings 26 and 28 of the workpieces 30 and 32. The recess 42 of the fastener 24 is located at an end opposite to the head 66 and that end protrudes beyond an accessible side of the workpiece 32. The shank 64 is externally threaded for threaded installation of nut 44. The fastener 24 is normally installed with the head 66 disposed on an inaccessible side or blind side of the workpiece 30. The key 16 on the fastener installation tool 10 supports and retains the fastener 24 against rotation during threaded installation of the nut 44. The nut 44 is engaged and driven by the socket 20 of the fastener installation tool 10 by advancing the nut 44 onto the shank 64.

As shown in FIG. 1, the fastener installation tool 10 comprises a tool component 12 and a head 14 adapted for mount-on quick-connect coupling to the drive end of the tool component 12, such as a rotary drive tool of the type known in the art. Other tool components could be used with the head 14 of the invention or alternatively configured heads that have a key 16, key holder 18, socket 20, spring 22 and gear 56. Upon actuation of the tool component 12, the tool component 12 supplies rotary drive motion through a gear train 68 mounted in the head 14 to the gear 56 for rotation of the socket 20 disposed in the gear 56. The socket 20 in turn has the non-circular seat 58 for receiving and rotatably driving the threaded nut 44. The key 16 is mounted within the tubular bore 36 in a slip fit generally coaxially within the socket 20. The diametric size of the tip end 40 is sufficiently small to fit through the threaded nut 44, so as to avoid interference with installation of the nut 44 onto the threaded fastener 24. The key 16 is carried within the tubular bore 36 for longitudinal sliding displacement, but is normally constrained against rotation relative to the fastener 24 by the mating engagement with the aperture 48 of the key holder 18.

In operation, the installer typically starts rotation of the nut 44 onto the threaded shank 64 of the fastener 24. Upon initial engagement, the tip end 40 is received into the recess 42, whereas the nut 44 is received into the seat 58. In this regard, the biasing spring 22 positions the tip end 40 to protrude axially beyond the nut 44 and seat 58.

When initial engagement between the tip end 40 and the recess 42 occurs, the fastener installation tool 10 is actuated to rotatably drive the socket 20. This rotatably advances the nut 44 onto the threaded shank 64. During this motion, the key 16 retains the shank 64 against rotation relative to workpiece 30, workpiece 32 and the socket 20. Nut 44 advancement is accompanied by the key 16 retracting within the head 14, until the nut 44 reaches the final installed position. Once the nut 44 reaches the final installed position, installation of the fastener 24 is complete.

Having described the presently preferred embodiments of the invention, it is to be understood that the invention may be otherwise embodied within various functional equivalents within the scope of the appended claims.

What is claimed is:

1. A fastener installation tool for installing a threaded nut with a non-circular external surface onto a threaded fastener of the type having a non-circular recess in an end of the fastener that matingly engages with a key, that has a complementary shaped non-circular tip end to the non-circular recess, the fastener installation tool comprising:

a head;

a rotatably operable gear disposed within the bead, the gear having a non-circular bore;

a socket, the socket having a non-circular seat configured to matingly engage the non-circular external surface of the nut;

the socket having a shaft with a non-circular external surface and a bore internal surface, the shaft matingly engaged within the non-circular bore of the gear;

the key having a shank with a non-circular external surface, the shank of the key being disposed within the bore of the shaft;

the tip end being configured to matingly engage with the non-circular recess in the fastener;

a key holder having a non-circular aperture that matingly engages the non-circular external surface of the shank, the key holder being attached to an exterior surface of the head; and a spring having one end of the spring attached to the key and another end of the spring attached to the head.

2. The fastener installation tool of claim 1 further comprising a tool component attached to the head.

3. The fastener installation tool of claim 1 wherein the external surface of the shaft has an annular groove disposed around a circumference of the shaft.

4. The fastener installation tool of claim 3 further comprising a ring seated within the annular groove which locks the socket to the gear.

5. The fastener installation tool of claim 1 wherein the key has a bore located adjacent to an end of the key opposite to the tip end.

6. The fastener installation tool of claim 5 wherein the one end of the spring is disposed within the bore and the other end of the spring is attached to the head with a fastener.

7. The fastener installation tool of claim 1 wherein the key has a slotted groove disposed in an end of the key opposite to the tip end.

8. The fastener installation tool of claim 7 wherein the one end of the spring is disposed within the slotted groove and the other end of the spring is attached to the head with a fastener.

9. The fastener installation tool of claim 1 wherein the shank of the key with the non-circular external surface that is matingly engaged with the non-circular aperture of the key holder both have non-circular shapes selected from the group consisting of one or more flats, flutes and splines.

10. The fastener installation tool of claim 1 wherein the spring operates to bias the key along a longitudinal axis of the shaft of the socket and retain the key to the fastener installation tool.

11. The fastener installation tool of claim 1 wherein the non-circular tip end that is configured to matingly engage with the non-circular recess of the fastener both have non-circular shapes selected from the group consisting of one or more flats, flutes and splines.

12. A kit for retrofitting a fastener installation tool that is used to install a threaded nut with a non-circular external surface onto a threaded fastener of the type having a non-circular recess in an end of the fastener that matingly engages with a key that has a complementary shaped non-circular tip end to the non-circular recess, the fastener installation tool comprising:

a head;

a rotatably operable gear disposed within the head, the gear having a non-circular bore;

a socket, the socket having a non-circular seat configured to matingly engage the non-circular external surface of the nut; and the socket having a shaft with a non-circular external surface and a bore internal surface, the shaft matingly engaged within the non-circular bore of the gear;

the kit, comprising:

the key having a shank with a non-circular external surface, and the shank of the key being configured to be disposed within the tubular bore of the shaft;

the tip end being configured to matingly engage with the non-circular recess in the fastener;

a key holder having a non-circular aperture that is configured to matingly engage the non-circular external surface of the shank, the key holder being configured to be attached to an the exterior surface of the head; and a spring having one end of the spring configured to be affixed to the key and another end of the spring configured to be attached to the head.

* * * * *